US006951161B2

(12) United States Patent
Ceola

(10) Patent No.: US 6,951,161 B2
(45) Date of Patent: Oct. 4, 2005

(54) SMOOTH BORE SECOND ENVIRONMENT SENSING

(75) Inventor: Kenneth Ceola, Prior Lake, MN (US)

(73) Assignee: Alliant Techsystems, Inc., Edina, MN (US)

( * ) Notice: Subject to any disclaimer, the term of this patent is extended or adjusted under 35 U.S.C. 154(b) by 0 days.

(21) Appl. No.: 10/737,032

(22) Filed: Dec. 17, 2003

(65) Prior Publication Data

US 2005/0132920 A1 Jun. 23, 2005

(51) Int. Cl.[7] ..... F42C 17/04
(52) U.S. Cl. ..... 89/6.5; 102/238
(58) Field of Search ..... 89/6, 6.5; 102/231, 102/232, 233, 238

(56) References Cited

U.S. PATENT DOCUMENTS

| | | | | |
|---|---|---|---|---|
| 3,750,583 A | * | 8/1973 | White et al. | 102/221 |
| 3,760,732 A | * | 9/1973 | Schuster et al. | 102/215 |
| 3,961,577 A | | 6/1976 | O'Steen | 102/70.2 |
| 4,694,752 A | * | 9/1987 | Titus | 102/215 |
| 5,390,604 A | | 2/1995 | Ingersoll | 102/211 |
| 5,497,704 A | | 3/1996 | Kurschner et al. | 102/264 |
| 5,693,906 A | | 12/1997 | Van Sloun | 102/251 |
| 5,705,766 A | | 1/1998 | Farace et al. | 102/215 |
| 6,151,563 A | | 11/2000 | Marinelli | 702/141 |
| 6,196,130 B1 | | 3/2001 | Crist et al. | 102/221 |
| 6,345,785 B1 | | 2/2002 | Harkins et al. | 244/3.23 |

FOREIGN PATENT DOCUMENTS

EP EU 0 412 523 A2 * 2/1991

OTHER PUBLICATIONS

English abstract of Eu 0 412 523 A2; 1 page; Feb. 1991.*
Department of Defense Design Criteria Standard; Fuze Design, Safety Criteria For Department of Defense; Not Measurement Sensitive; MIL-STD-1316E; Jul. 10, 1998; Superseding MIL-STD-1316D, Apr. 9, 1991, 25 pages.

* cited by examiner

*Primary Examiner*—Stephen M. Johnson
(74) *Attorney, Agent, or Firm*—Vidas, Arrett & Steinkraus PA

(57) ABSTRACT

A safety and arming apparatus for arming a fuze of a smooth bore projectile, comprises a setback sensor and a spin rate sensor. The setback sensor is in cooperative electronic communication with the spin rate sensor such that when the setback sensor senses at least one predetermined setback condition and the spin rate sensor detects a predetermined number of spins within a predetermined window of time the fuze is armed.

13 Claims, 2 Drawing Sheets

SMOOTH BORE SECOND ENVIRONMENT SENSING

CROSS-REFERENCE TO RELATED APPLICATIONS

Not Applicable

STATEMENT REGARDING FEDERALLY SPONSORED RESEARCH

Not Applicable

BACKGROUND OF THE INVENTION

A safety and arming device is a required element of a munition to ensure that the munition is not armed and detonated until the desired time. The safety and arming device (S & A) is part of a munition's fuze and prevents arming of the fuze until certain conditions are met.

It is desirable to provide a munition with at least two unique environments, conditions or occurrences to take place in order for fuze arming to occur. In many munitions, typically the first environment utilized is usually setback for gun fired munition fuzing. Setback acceleration of gun fired munitions, due to its large magnitude, is an easily mechanically sensed environment. Fuze power is frequently not available at setback, necessitating a mechanical environment sensor.

Effective mechanically sensed second environments may be more difficult to sense. For example, in some munitions the spin or number of rotations of the munition in flight can be used as a fuzing environment. However, environments such as the number of rotations can be difficult to mechanically sense, and not sufficiently unique.

In barrel fired munitions, a rifled or twist bore has grooves which impart the munition projectile with a high degree of spin. The spin provides improved accuracy and stability. The high degree of spin is often used as a second environment in twist bore barrel applications. In smooth bore weapons however, a high degree of spin is not imparted to the projectile. Thus, munitions of smooth bore weapons have not previously employed spin, or rotation count as a second environment.

As indicated, both setback and high levels of spin are relatively simplistic to sense mechanically and have been used to implement first and second environments for fuzing of artillery rounds employed in twist bore applications.

In the case of smooth bore applications, such as smooth bore mortars, high G levels at firing may be employed as a first environment, but because no spin is imparted to the mortar, use of spin as a second environment is problematic. In past applications, mortar rounds have typically included wind driven turbines to release locks or generate power to provide a second fuzing environment. This has created a significant logistic problem, as entirely different fuze families have resulted, for example, twist barrel artillery round fuzes and smooth bore mortar fuzes.

While spin is not imparted to smooth bore projectiles via barrel twist, some level of spin is necessary to reduce dispersion, and thus increase accuracy, of the fuzed projectile. This spin is generally imparted to the round via canted fins inducing spin due to air flow after entry of the projectile into the air stream. The spin is generally about two to three times the aerodynamic resonance of the projectile, and is typically in the tens of hertz as opposed to the spin imparted to twist bore projectiles which is often in the thousands of hertz. In the past, measuring and utilizing the low spin rates of smooth bore projectiles as a second fuzing environment has not been practical.

It is a goal of at least one embodiment of the present invention to provide an electronic spin sensor capable of detecting the fin induced lower spin necessary to reduce dispersion in all smooth bore rounds. The fin induced lower spin may be detected within a time window to produce a unique second environment detectable by the sensor.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

The present invention is directed to several embodiments. In at least one embodiment, the invention provides a safer safety and arming device which utilizes a first sensor to detect a first environment and a second sensor for detecting a second environment. The device is utilized with smooth bore projectiles which are constructed to impart spin upon themselves when fired, such as, for example, mortar rounds having canted fins.

In at least one embodiment of the invention, the first environment detected is setback. In such an embodiment the first environment sensor is an electromechanical safe and arm (S&A) device such as is described in U.S. Pat. No. 5,963,906 for example.

In embodiments utilizing the S&A mentioned above, the S&A provides for adjustable setback levels allowing its use with various levels of setback as may be encountered in various twist bore applications. Recognition of the setback enables arming, but the S&A remains out of line until a unique second environment is recognized. In some embodiments the second environment is the low degree of spin within a window of time described herein.

In at least one embodiment spin is detectable by a spin sensor such as is described in U.S. Pat. No. 5,497,704 for example. The spin sensor of U.S. Pat. No. 5,497,704 is capable of measuring the low spin rates of a smooth bore projectile where spin is projectile induced. The electronics of the sensor may be tailored via software or firmware to allow the same sensor (fuze) to be used for both smooth and twist bore applications. In addition to measuring the spin, the electronics of the second environment sensor defines a lower threshold that the spin must achieve, and require that the spin rate exceeds that threshold with in a predetermined time window. The time zero ($T_0$) for this time window may be based on either a setback closed T0 switch for pre-launched activated batteries or a specific voltage level reached during battery rise times for launched activated batteries. It would also be possible to profile this spin to provide yet additional environment discriminations.

In some embodiments a projectile is fitted with a combination of the first and second environment sensors such as those described in U.S. Pat. No. 5,963,906 and U.S. Pat. No. 5,497,704.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described a preferred embodiment to the invention.

BRIEF DESCRIPTION OF THE SEVERAL VIEWS OF THE DRAWINGS

Referring to the Drawings, wherein like numerals represent like parts throughout the several views.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated. The concepts described above are considered to be read into the further description below.

Figure 1:
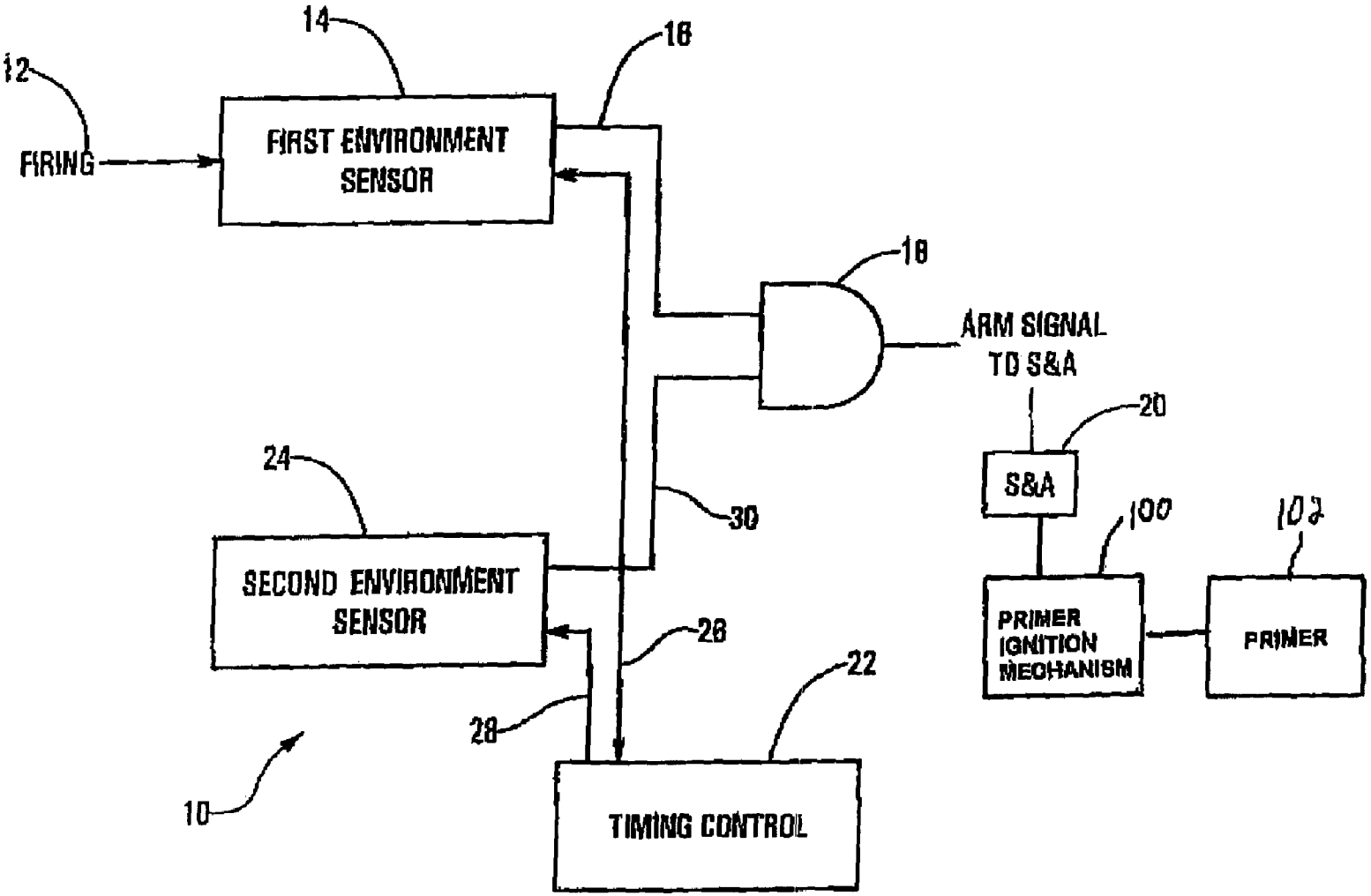
FIG. 1 is a block diagram of the safety and arming apparatus of the invention.

Referring now to FIG. 1, a block diagram of a weapon fuze system for a projectile which is to be fired from a smooth bore barrel is shown, with the fuze system generally shown at 10. The weapon fuze system requires the existence of two environments to initiate S&A.

Figures 2, 3:
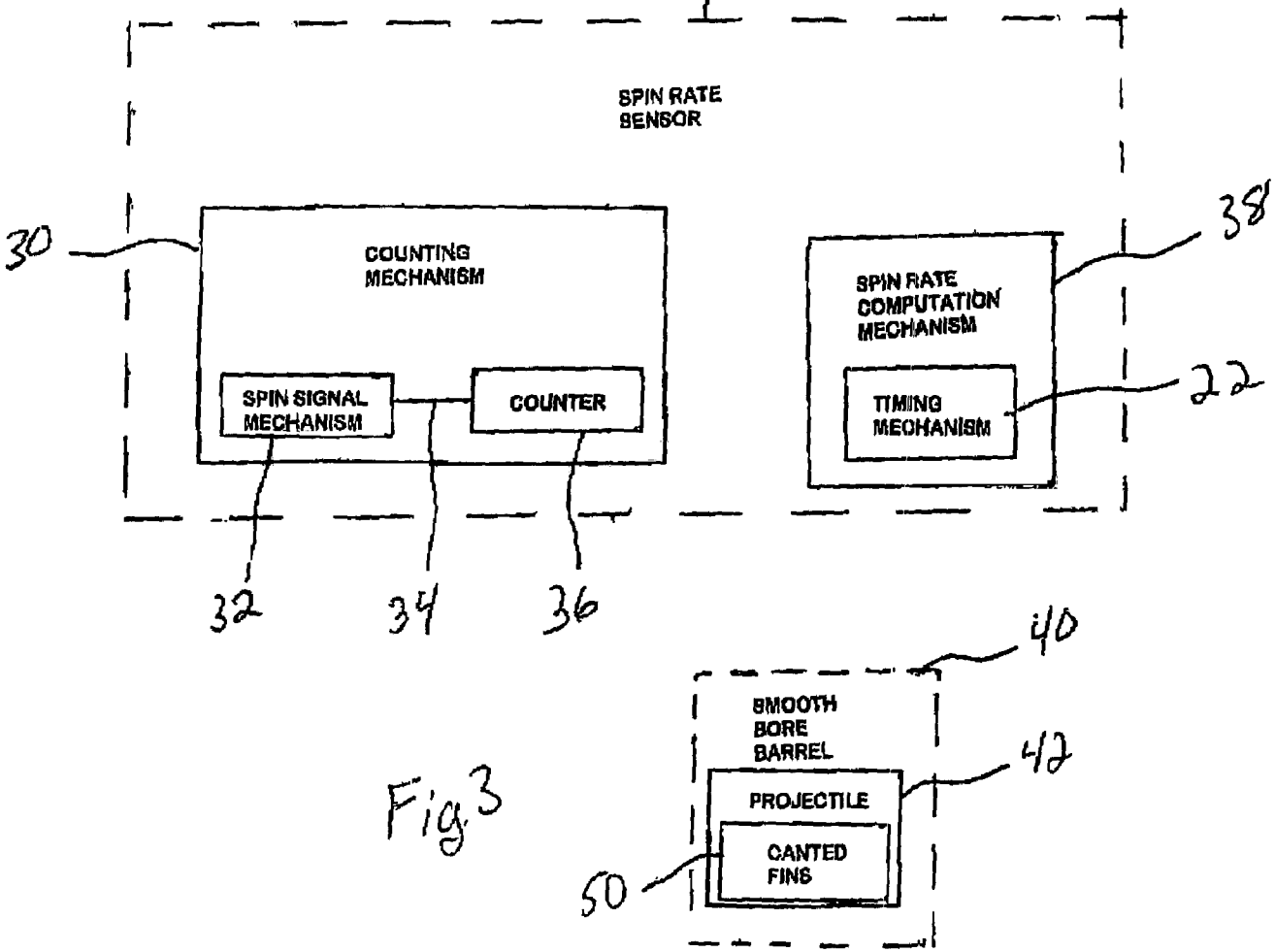
FIG. 2 is a block diagram of a portion of the invention.
FIG. 3 is a block diagram of a portion of the invention.

For the present invention, the weapon may be a smooth bore projectile 42, which is launched from a smooth bore barrel 40 and is equipped with a spin inducing mechanism, such as a plurality of canted fins 50, as schematically shown in the block diagram of FIG. 3. The plurality of canted fins are positioned so as to induce spin upon the introduction of air flow when the weapon is projected into the air stream. This spin reduces dispersion. The use of canted fins is well known in the art. This spin is generally about two to three times the aerodynamic resonance of the projectile and typically in the tens of hertz, whereas twist bore induced spin is in the thousands of hertz.

The weapon fuze system 10 receives an input upon firing, shown at 12, by the first environment sensor 14. The first environment sensor 14 may be any conventional sensor which senses the acceptable firing of a projectile. Examples are setback sensors and muzzle exit sensors. These types of sensors are well known in the art.

If the first environment is achieved, a positive or high signal is latched and sent along line 16 to AND gate 18, which outputs to the safety and arming block 20.

Prior to arming and upon entry into the air stream, the weapon will start to spin due to the canted fins, which will then be used as a second environment to verify it is safe to arm the weapon. The second environment is rate of spin, which is a sensed by spin sensor 24, such as is described in U.S. Pat. No. 5,497,704, for example. The second environment requires that the spin exceed a threshold within a time window. This time window is based on either the first environment verification, such as a setback closed T0 switch for pre-launched activated batteries or battery rise times for launched activated batteries. The present invention also contemplates profiling the spin to provide additional environment discrimination.

The weapon fuzing system 10 is also comprised of a timing control block 22, which is used by the second environment sensor to determine whether the second environment is achieved. Such timing control systems are well known in the art. The timing/control block 22 is in communication with the first environment sensor 14 along line 26 and typically starts timing upon firing or the verification of the first environment. The timing control block 22 is also in communication with the second environment sensor 24 along line 28, which uses the information to determine whether the second environment occurs within the required time window.

The second environment sensor 24 measures the rate of spin of the weapon and uses the information from the timing control 22 to determine whether the second environment has been achieved, that is whether the projectile has achieved a certain spin rate or has achieved a certain spin rate within a certain time window. If the second environment is achieved, a positive or high signal is sent along line 30 to AND gate 18, which outputs to the safety and arming block 20. The spin rate sensor 24 is operatively engaged to a primer ignition mechanism 100. The primer ignition mechanism 100 ignites an electrically actuated primer 102 when the spin rate sensor 24 detects the second condition.

As schematically shown in the block diagram of FIG. 2, the spin rate sensor 24 includes a counting mechanism 30 for counting each said rotation of the smooth bore projectile as it rotates around its longitudinal axis. The counting mechanism 30 includes a spin signal mechanism 32 for generating a spin signal 34 which varies over time as the smooth bore projectile rotates about its axis in the earth's magnetic field. The spin signal may be a sine wave and the crossings of the x axis by the sine wave are used to determine frequency, which is used to determine spin rate. Preferably, the second condition is a spin rate of about 100 Hertz or less. The magnitude of the spin signal reaches a predetermined threshold a predetermined number of times for each said rotation of the smooth bore projectile. The counting mechanism 30 also includes a counter 36 operatively connected to the spin signal mechanism 32 for counting the number of times the spin signal 34 reaches its predetermined threshold. The spin rate sensor 24 further includes a spin rate computation mechanism 38 for determining a spin rate of the smooth bore projectile. The spin rate computation mechanism 38 includes the timing mechanism 22 which is operatively connected to the counter 36 for determining the time for the smooth bore projectile to rotate a predetermined number of times.

If inputs from both sensor blocks (14, 24) to AND gate 18 are high, then the output to the safety and arming block goes high to arm the weapon, as is well known in the prior art.

Spin rates and time windows are established by the projectile being fuzed. It should be understood that the system may be used without a timing control and just measure the rate of spin of the projectile for the second environment. However, this is less desirable.

While not specifically detailed, it will be understood that the various electronic functional blocks are properly connected to appropriate bias and reference supplies so as to operate in their intended manner. It should also be understood that the processing described herein utilizes well known technology. Further, any circuitry configurations and applications thereof other than as described herein can be configured within the spirit and intent of this invention.

In addition to being directed to the specific combinations of features claimed below, the invention is also directed to embodiments having other combinations of the dependent features claimed below and other combinations of the features described above.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

What is claimed is:

1. A safety and arming apparatus for arming a fuze of a smooth bore projectile, comprising:

a first sensor and a spin rate sensor, the first sensor in cooperative electronic communication with the spin rate sensor, such that, when the first sensor senses a predetermined first condition and the spin rate sensor detects a predetermined second condition, the predetermined second condition being a predetermined number of spins within a predetermined window of time, the fuze is armed, wherein the spin rate sensor comprises:

(a) a counting mechanism for counting each said rotation of the smooth bore projectile as it rotates around its longitudinal axis, the counting mechanism comprising:

(i) spin signal mechanism for generating a spin signal which varies over time as the smooth bore projectile rotates about its axis in the earth's magnetic field and where the magnitude of the spin signal reaches a predetermined threshold a predetermined number of times for each said rotation of the smooth bore projectile;

(ii) a counter operatively connected to the spin signal mechanism for counting the number of times the spin signal reaches its predetermined threshold; and (b) a spin rate computation mechanism for determining a spin rate of the smooth bore projectile, wherein the spin rate computation mechanism is comprised of a timing mechanism operatively connected to the counter for determining the time for the smooth bore projectile to rotate a predetermined number of times.

2. The safety and arming apparatus of claim 1, wherein the spin rate sensor is operatively engaged to a primer ignition mechanism and wherein the primer ignition mechanism ignites an electrically actuated primer when the spin rate sensor detects the second condition.

3. The safety and apparatus of claim 1, wherein the spin signal is a sine wave and the crossings of the x axis by the sine wave are used to determine frequency, which is used to determine spin rate.

4. The safety and arming apparatus of claim 1, the smooth bore projectile having a spin inducing mechanism, wherein the spin inducing mechanism causes the smooth bore projectile to spin after being fired.

5. The safety and arming apparatus of claim 4, wherein the spin inducing mechanism is a plurality of canted fins.

6. The safety and arming apparatus of claim 4, wherein the second condition is a spin rate of about 100 Hertz or less.

7. The safety and arming apparatus of claim 6, the first sensor being a setback sensor and the first predetermined condition being setback when the smooth bore projectile is fired.

8. The safety and arming apparatus of claim 1, wherein the second condition is a spin rate of about 100 Hertz or less.

9. A method of arming a fuze of a smooth bore projectile, comprising:

providing a smooth bore barrel;

inserting a smooth bore projectile in the smooth bore barrel, the smooth bore projectile including a spin inducing mechanism, said spin inducing mechanism being positioned and designed to impart spin upon the smooth bore projectile when said smooth bore projectile is fired into an air stream, a first sensor and a spin rate sensor, the first sensor in cooperative electronic communication with the spin rate sensor;

firing the smooth bore projectile into the air stream at a high speed;

determining whether a first predetermined condition is achieved;

determining whether a second predetermined condition is achieved, wherein the second predetermined condition is a predetermined number of spins within a predetermined window of time; and arming the fuze if the first and second predetermined conditions are achieved.

10. The method of claim 9, wherein the second predetermined condition is a spin rate induced by the projectile being fired and entered into the air stream.

11. The method of claim 10, wherein the first predetermined condition is setback.

12. The method of claim 9, wherein the spin inducing mechanism is a plurality of canted fins.

13. The method of claim 9, wherein the second predetermined condition is a spin rate of about 100 hertz or less.

* * * * *